US007980506B2

(12) United States Patent
Kling et al.

(10) Patent No.: US 7,980,506 B2
(45) Date of Patent: Jul. 19, 2011

(54) DISPENSER FOR PRODUCTS IN SHEET FORM

(75) Inventors: Robert Kling, Skene (SE); Erik Hjort, Sater (SE); Per Moller, Leksand (SE); Anders Gustafsson, Billdal (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 12/306,997

(22) PCT Filed: Jul. 7, 2006

(86) PCT No.: PCT/SE2006/000856

§ 371 (c)(1),
(2), (4) Date: Dec. 30, 2008

(87) PCT Pub. No.: WO2008/004919

PCT Pub. Date: Oct. 1, 2008

(65) Prior Publication Data

US 2009/0314874 A1 Dec. 24, 2009

(51) Int. Cl.
*B65H 67/02* (2006.01)

(52) U.S. Cl. ..... 242/560; 242/559.3; 242/561

(58) Field of Classification Search ..... 242/558, 242/559, 559.1, 559.3, 559.4, 560, 560.1, 242/560.2, 560.3, 561
See application file for complete search history.

(56) References Cited

U.S. PATENT DOCUMENTS

| | | | | |
|---|---|---|---|---|
| 2,767,930 | A * | 10/1956 | Mccants | 242/560.3 |
| 3,058,682 | A | 10/1962 | Mott | |
| 3,382,021 | A | 5/1968 | De Woskin | |
| 3,437,388 | A | 4/1969 | Jespersen | |
| 3,572,602 | A * | 3/1971 | Mott et al. | 242/560.3 |
| 3,770,222 | A | 11/1973 | Jespersen | |
| 4,206,858 | A | 6/1980 | DeLuca et al. | |
| 4,844,361 | A * | 7/1989 | Granger | 242/561 |
| 4,944,466 | A * | 7/1990 | Jespersen | 242/560.3 |
| 5,288,032 | A | 2/1994 | Boone | |
| 5,558,302 | A * | 9/1996 | Jesperson | 242/560 |
| 5,628,474 | A * | 5/1997 | Krueger et al. | 242/560 |
| 6,082,664 | A * | 7/2000 | Phelps et al. | 242/560 |
| 7,338,007 | B2 * | 3/2008 | Valot | 242/560 |
| 2008/0078855 | A1 | 4/2008 | Forman | |

FOREIGN PATENT DOCUMENTS

| | | |
|---|---|---|
| EP | 0351187 | 1/1990 |
| RU | 2110944 C1 | 5/1998 |
| WO | 9304965 | 3/1993 |

OTHER PUBLICATIONS

International Search Report dated Feb. 7, 2007, in PCT application.
Decision to Grant in Corresponding Application No. 2009104040 filed Jul. 7, 2006.

* cited by examiner

*Primary Examiner* — William A Rivera

(74) *Attorney, Agent, or Firm* — Young & Thompson

(57) ABSTRACT

A dispenser for rolls of flexible sheet material, each of the rolls having spindle elements extending axially outwardly beyond the ends thereof, wherein a first roll is located in a dispensing position. Alternatively, a second roll may be located in a reserve position. The dispenser further includes a stub roll position arranged to receive a first roll exhausted to a predetermined extent. Retaining elements are arranged on both sides of the stub roll position to support the spindle elements inserted into each end of a roll, wherein the retaining elements arranged for simultaneous release of the spindle elements when the dispenser is opened.

16 Claims, 4 Drawing Sheets

DISPENSER FOR PRODUCTS IN SHEET FORM

TECHNICAL FIELD

The present invention relates to a dispenser for rolls of web-shaped material, such as paper and non-woven sheets, said dispenser comprising a housing having at its bottom part an outlet opening for the web-shaped material and a space for at least two rolls. A first part of the space is located adjacent the outlet opening and is intended for a first roll in a dispensing, or use position and a second part of the space may be provided for keeping the second roll in a standby position. The first part is provided with holding means cooperating with spindle means in the first roll in order to support the roll in the dispensing position. When the first roll is nearly exhausted it is released and displaced into a stub roll position, in which retaining means for the spindle means are provided.

BACKGROUND ART

Dispensers for multiple rolls of web-shaped material, such as paper and non-woven sheets, are often provided with a stub roll position in which a substantially exhausted roll is located. When the stub roll is completely exhausted the remaining spindle means or core means may simply be released from the dispenser. This is often the case when rolls are provided with separate spindle means inserted into the ends of a roll or when split core rolls are used. A dispenser of this type is known from U.S. Pat. No. 3,437,388 showing a roll dispenser for split core rolls.

A problem with these solutions is that the spent spindle means or core halves are allowed to drop out of the dispenser onto the floor, causing a litter problem. This can also create additional, unnecessary work for maintenance staff that must search the floor for spent spindle means or core halves.

U.S. Pat. No. 5,288,032 describes a dispenser provided with a container for receiving spent residual roll elements. According to this solution spent roll elements are allowed to drop out of a dispensing position into the container for later removal.

A problem with this type of dispenser is that a spent roll element may be caught or wedged in the dispensing position, preventing a reserve roll from reaching the dispensing position and causing a malfunction of the dispenser. Additionally, a separate container or space for storing spent spindle means or cores must be provided inside the lower end of the dispenser. Because the dispensed web is usually removed through an opening at the bottom of the dispenser, such a container may obstruct the user's access to the web. This makes this particular solution unsuitable for dispensers with rolls mounted on horizontal axes at right angles to a wall supporting the dispenser.

The above problems are solved by a dispenser according to the invention, which dispenser provides an improved arrangement for handling not only separate spindle means, but also spindles mounted in split or solid cores.

DISCLOSURE OF INVENTION

The object of the invention is achieved by a dispenser for rolls of flexible sheet material according to the invention, having the characteristic features defined in the appended claims.

According to one embodiment, the invention relates to a dispenser for rolls of flexible sheet material, each of said rolls having spindle means extending axially outwardly beyond the ends thereof, wherein a first roll is located in a dispensing position. A second roll may preferably, but not necessarily, be located in a reserve position above said dispensing position. The dispenser further comprises a stub roll position arranged to receive a first roll exhausted to a predetermined extent. A sensor means may be provided to monitor the diameter of the roll and release it from the dispensing position, from which it may be displaced into the stub roll position. The spindle means may cooperate with a pair of guide slots connecting the dispensing position and the stub roll position to direct the downwards movement of the first roll. Retaining means may be arranged on both sides of the stub roll position to support the spindle means inserted into each end of a roll, wherein the retaining means arranged for simultaneous, or substantially simultaneous release of the spindle means when the dispenser is opened. Depending on the location of a means cooperating with the cover for releasing the spindle means, the spindle means may be released at any suitable time between the unlocking of the cover and the cover being completely opened. Preferably the cover should be opened sufficiently to catch the spindle means in the cover when they are released.

When the nearly exhausted first roll is released from the dispensing position it may be displaced towards the stub roll position under the influence of gravity, by a user pulling the web, by a reserve roll coming into contact with the first roll while moving into the dispensing position, or by a combination of one or more of these actions. The retaining means are arranged to rotatably support the spindle means of the roll located in the stub roll position both during removal of the last web section and after the roll has been exhausted.

In order to support the roll the retaining means and the spindle means are provided with cooperating interlocking surfaces. The retaining means may comprise a keyed slot having a cross-sectional shape corresponding at least in part to an axial cross-sectional shape of the spindle means. According to one example, the retaining means comprises a keyed slot arranged to support a spindle means provided with an axially outer, enlarged section. Preferably the outer section of the spindle means has a rotation symmetrical shape with a relatively larger diameter, and an axially inner, cylindrical section, has a relatively smaller diameter. The outer section may have a substantially conical shape with its apex facing the said inner section. Such a substantially conical outer section may preferably, but not necessarily, be provided with a cylindrical end section. A suitable type of spindle means is described in the international patent application no. WO 2006/050043 which is hereby incorporated by reference. However, the dispenser according to the invention may also use spindles having fixed outer ends, providing that the shape of said ends may cooperate with the said guide slots and catches. Although an outer, substantially conical section is preferred, other shapes such as a hemispherical or cylindrical are also possible. At least one retaining means may comprise a catch resiliently held in contact with a circumferential surface of the end section of a spindle means. According to a preferred example, the catch may be arranged on a pivotable lever with a pivot joint having an axis parallel to the axis of the roll. A resilient means such as a spring may hold the catch in a spring loaded, active position to act as a brake on the spindle means in the stub roll position. According to an alternative example, a catch may be provided on either side of the stub roll in order to assist in retaining the spindle means when the stub roll has been exhausted.

The retaining means may comprise a pivotable lever located on either side of the stub roll position. In order to ensure simultaneous release of the spindle means, the levers may be connected by a transverse bar parallel to the roll axis.

The transverse bar is preferably, but not necessarily, arranged to coincide with the pivot axis of the pivotable lever. The retaining means may be arranged to release the spindle means when a dispenser cover is moved from a closed to an open position. The cover comprises a front, side and upper surfaces and may be removed by tilting an upper end of the cover outwards and downwards, about a pivot axis through a lower section of the side surfaces of the dispenser. The lever adjacent the front of the dispenser may be provided with a contact surface that is in contact with and supported by an inner side surface of the dispenser cover. When the cover is opened beyond a predetermined angle, the contact surface on the lever will disengage the cover, allowing the lever to pivot away from the stub roll position. This movement will also disengage the retaining means from the spindle means in order to release them. The levers may be arranged to be actuated under the influence of gravity, as the centre of gravity of the levers is located to one side of a vertical plane through the pivot axis of the levers. Alternatively, a resilient means, such as a resilient tongue on the lever, may bias the levers and the contact surface into contact with the inner surface of the cover when closed. As soon as the cover is opened, the resilient means may initiate the pivoting movement of the levers to release the spindle means. The keyed slots in the levers making up the retaining means may be substantially hook- or J-shaped. As the levers are pivoted the spindle means will automatically fall out of the slots, whereby the spindle means will drop down into and be caught by the opened cover.

According to a preferred embodiment, the spindle means comprises separate adapters inserted into each end of a roll. If the adapters are inserted into each end of a coreless roll, the retaining means will keep the spindle means from dropping out of the roll dispenser until the cover is opened for re-filling. Similarly, if the spindle means comprises adapters inserted into each end of a roll provided with a split core, the spindle means and both halves of the core will be retained in the dispenser. Although not primarily intended for rolls of the said type, the dispenser may also be operated using adapters inserted into each end of a roll with a solid core or a spindle means comprising a pair of adapters joined by an axle or similar arranged along the central axis of a roll. Alternatively, the spindle means may comprise adapters adhesively attached to each end of a coreless or solids roll. In this way it is possible to prevent the spindle means from an exhausted roll from dropping out of the dispenser and littering the floor.

BRIEF DESCRIPTION OF DRAWINGS

In the following text, the invention will be described in detail with reference to the attached drawings. These schematic drawings are used for illustration only and do not in any way limit the scope of the invention. In the drawings.

EMBODIMENTS OF THE INVENTION

Figure 1:
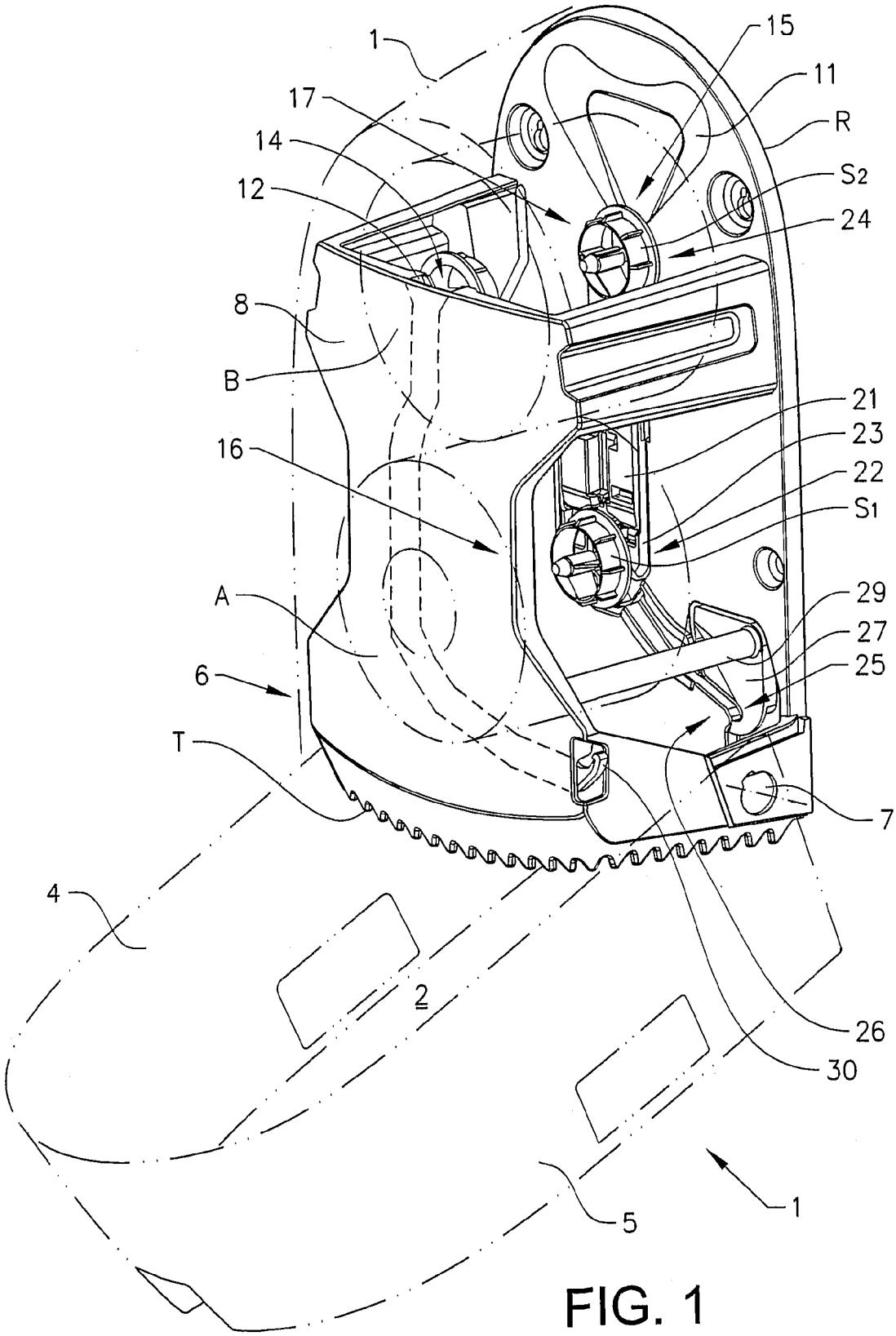
FIG. 1 shows a perspective front view of a dispenser according to a first embodiment of the invention.

FIG. 1 shows a perspective view of a dispenser according to a first embodiment of the invention. In the subsequent text the terms "inner" and "outer" are used to denote the position of components in relation to a rear section R, unless otherwise indicated. The rear section R is intended to be mounted on a wall or a similar vertical or near vertical surface. In the examples described below, the rolls are placed in the dispenser with their axes at substantially right angles to the rear section R of the wall mounted dispenser. The dispenser is primarily intended for coreless rolls having central spindle means $S_1$, $S_2$ inserted into the ends of the roll and extending axially outwardly beyond the ends of the roll. The dispenser comprises a cover 1 (indicated in dash-dotted lines) with a front surface 2, an upper surface 3 and a pair of side surfaces 4, 5. The cover 1 is opened by folding the entire cover forwards, from the position indicated by dash-dotted lines, and downwards to the position shown. The cover 1 is pivoted about a pair of pivot joints 6, 7 located at the lower edge of the respective side surfaces 4, 5 on either side of the dispenser. The dispenser 1 is mounted to a substantially vertical surface by means of a rear section R. A tear means T is arranged around the lower edges of the dispenser, which tear means T is attached to the lower edge of a frame 8 mounted on the rear section R. The dispenser is arranged for receiving two rolls A, B (indicated with dashed lines) which are inserted at the top of the dispenser by locating the spindle means in relation to converging guide surfaces 11, 12 in the rear section R and in the frame 8 mounted onto the rear section and extending outwards to substantially envelop the rolls A, B at the front of the dispenser. The frame 8 is open at the top to allow inserting of rolls and open at the bottom to allow removal of web material. Guide slots 14, 15 are provided in the rear section R and the inner surface of the frame 8, respectively, to guide the rolls A, B from a reserve position 17 down through the dispenser into a dispensing position 16 as indicated by the respective spindles $S_1$, $S_2$ in FIG. 1.

The dispenser is provided with an automatic roll changing mechanism comprising a first sensor means 21 for determining that the first roll A located in the dispensing position 16 is nearly exhausted, a first catch 22 for supporting the first roll A in a dispensing position, a second sensor means 23 for determining that the first roll has been released from the dispensing position, and a second catch 24 for supporting the second roll B in the reserve position 17. In the dispenser shown in FIG. 1, identical first sensors and first catches are located on both sides of the first roll A in the rear section R and the inner surface of the frame 8 respectively. The second sensor and the second catch are preferably, but not necessarily, provided on one side only. When the first roll A is released it will move downwards to a stub roll position 25.

In operation, spring loaded, roll change initiating first sensor means 21 will start to move when the first roll A has been reduced to a certain pre-determined diameter. The sensor movement will cause a pair of first catches 22 supporting the first roll A in the dispensing position 16 in the dispenser to be moved out of contact with their spindle means S1 or roll support adapter. The first roll A still has a small amount of paper left and under the influence of gravity and/or the user pulling the paper, the roll A will move to the stub roll position 25. In the stub roll position 25 the paper will be removed until the roll A is completely exhausted. When the first roll A moves towards the stub roll position 25 a second spring loaded sensor means 23 will be actuated. Actuation of the second sensor means 23 will cause the second catch 24 to release the second roll B from the reserve position 17. When released, the second roll B will move under the influence of gravity to take its place in the dispensing position 16. As the second roll B moves into the dispensing position, the end surfaces of the roll will simultaneously displace the first sensors 21 outwards against a spring load into contact with the respective end surfaces of the second roll B and move the first catches into contact with their respective spindle S2 means.

In this way paper is always available on the first roll A during the roll change. The relatively small first roll A needs to be moved away from the regular dispensing position 16 to leave space for the new, second roll B, allowing it to drop into position. The first roll A may be moved to its stub roll position by gravity, by pull force from paper that is removed by a user, or by a combination of both. To ensure that the first roll A is correctly located in the stub roll position 25, the second roll B may also push the first roll A into the stub roll position 25 just before reaching its dispensing position 16. When this occurs, sufficient inertia is transferred to the first or stub roll A to push it into the sub roll position 25. At the same time, the speed of the second roll is reduced, resulting in a relatively soft landing of the new roll in the dispensing position.

Figure 2:
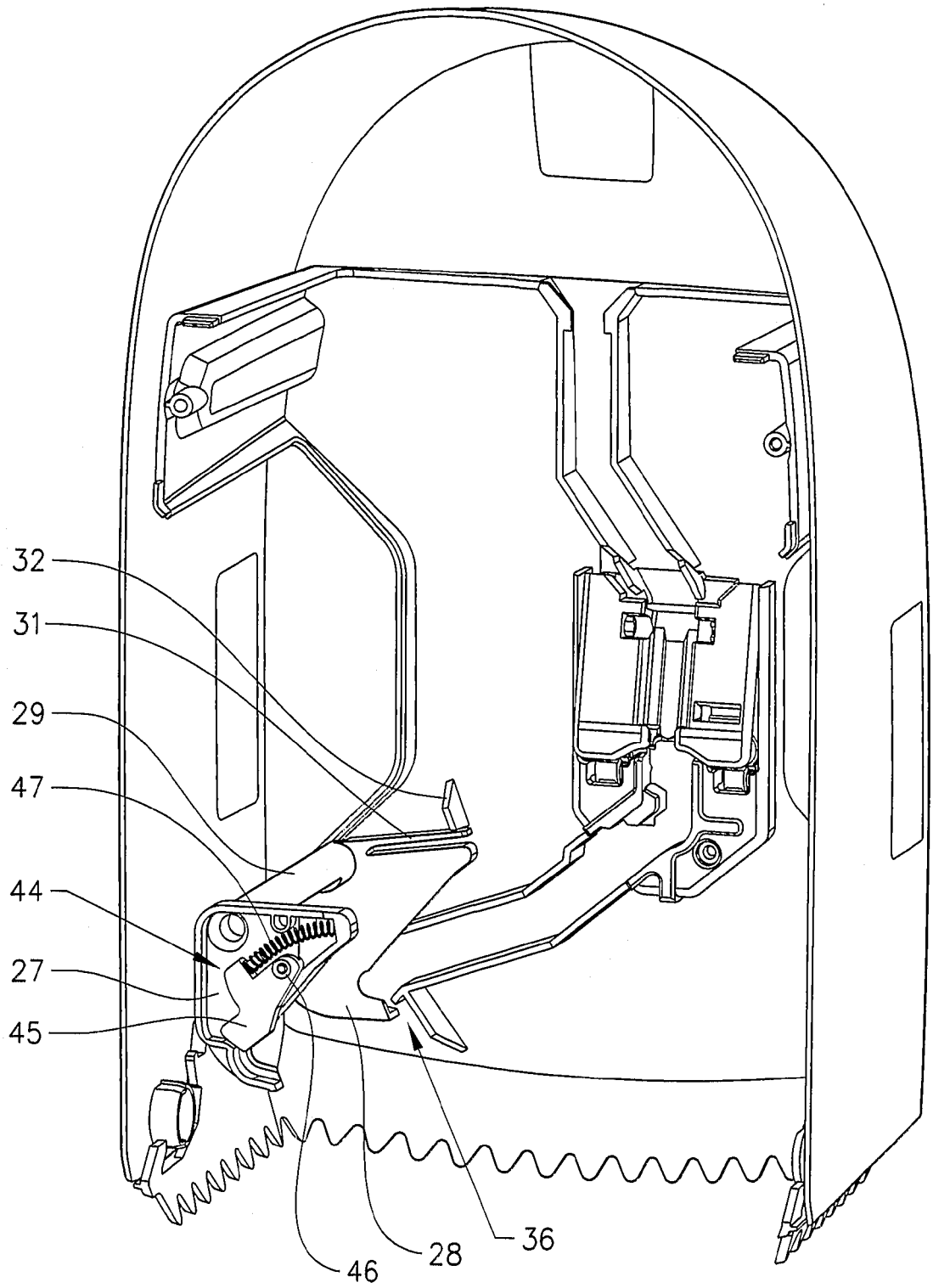
FIG. 2 shows a perspective rear view of the dispenser in FIG. 1.

The stub roll is held in the stub roll position 25 by a retaining mechanism 26 that ensures that the inner and outer spindles $S_1$ remain in the dispenser when the web is exhausted. The retaining mechanism 26 is shown in FIGS. 1 and 2 and comprises inner and outer pivotable levers 27, 28 located on both sides of the stub roll. FIG. 2 shows a perspective rear view of the frame and the dispenser cover. In order to ensure simultaneous release of the spindle means, the levers 27, 28 are connected by a transverse bar 29 parallel to the roll axis. The transverse bar 29 is arranged to coincide with the pivot axis of the pivotable levers 27, 28. The retaining mechanism 26 is arranged to release the spindle means when the dispenser cover 1 is moved from a closed to an open position. As described above, the cover 1 comprises a pair of side surfaces 4, 5 and can be removed by tilting an upper end of the cover outwards and downwards, about a pair of pivot joints 6, 7 through a lower section of the side surfaces of the dispenser. The outer lever 28 (see FIG. 2) adjacent the front 2 of the dispenser is provided with a contact surface in the form of a projection 30 that is in contact with and supported by an inner side surface 5 of the dispenser cover 1. When the cover 1 is opened beyond a predetermined angle, the projection 30 on the lever 28 will disengage the side surface 5, allowing the levers 27, 28 to pivot away from the stub roll position 25. The levers 27, 28 are arranged to be actuated under the influence of gravity, as the centre of gravity of the levers 27, 28 is located to one side of a vertical plane through the pivot axis of the levers. Additionally, a resilient means in the form of a resilient tongue 31 on the outer lever 28 will bias the levers 27, 28 and the projection 30 into contact with the inner surface of the side surface 5 of the cover 1 when closed. The resilient tongue 31 is integrated in the outer lever 28 and has a free end in contact with a stop 32 on the inner side of the frame 8. When the cover 1 is being closed, the resilient tongue 31 will be deformed as its free end contacts the stop 32 during continued pivoting of the levers 27, 28. As soon as the cover 1 is opened beyond a predetermined angle, the resilient tongue 31 will initiate the pivoting movement of the levers 27, 28 to release the spindle means.

Figure 3:
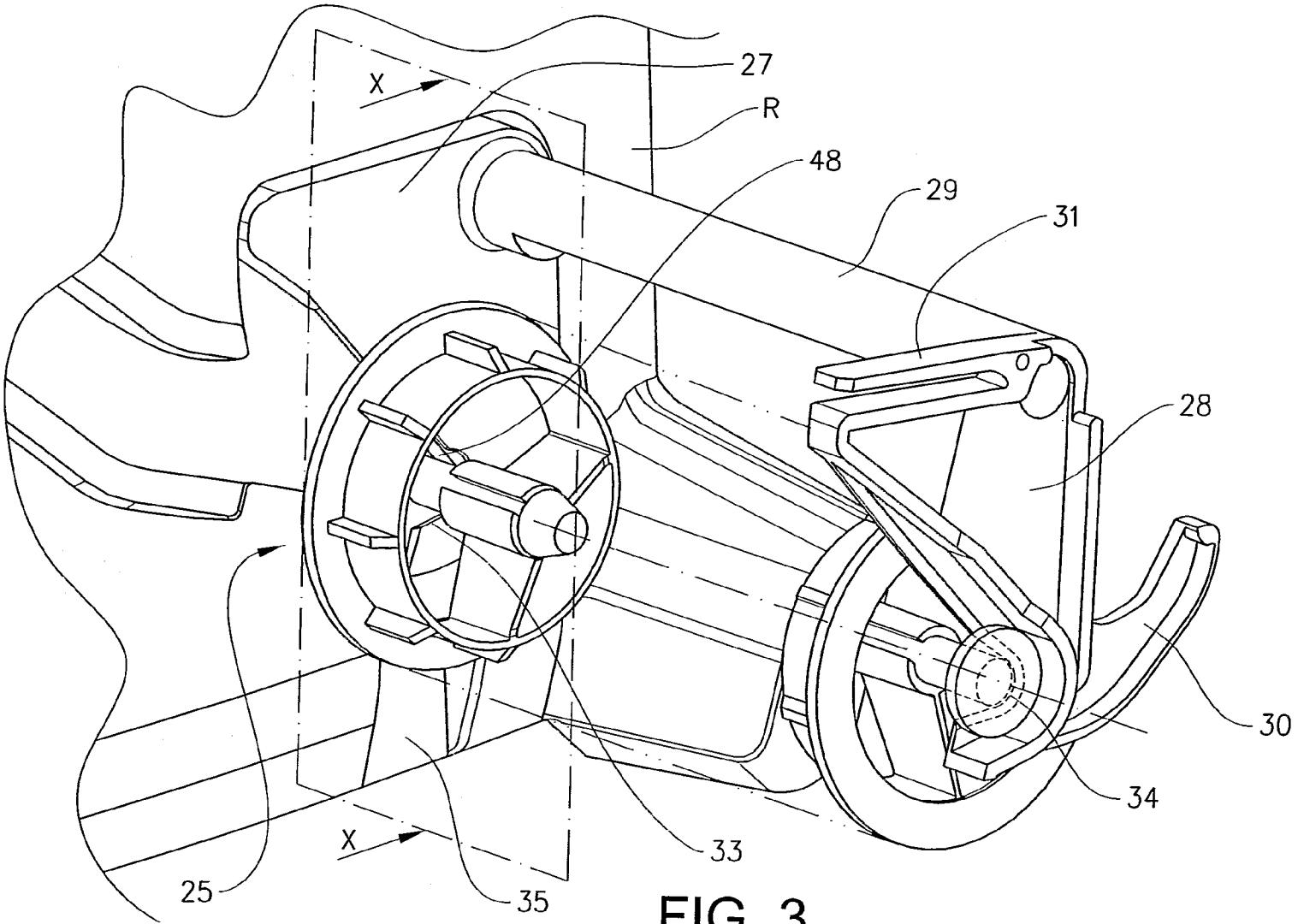
FIG. 3 shows an enlarged view of the retaining mechanism in FIG. 2.

FIG. 3 shows a retaining mechanism according to the invention, wherein the mechanism is shown mounted in the rear section R of the dispenser. The retaining mechanism is provided with keyed slots 33, 34 in the levers 27, 28 which slots are substantially hook- or J-shaped. As the cover is opened, the levers 27, 28 are pivoted about the transverse bar 29 and the spindle means will automatically fall out of the keyed slots 33, 34 as the J-shaped slots are tilted downwards. The spindle means will be released through exit slots 35, 36 and drop down into and be caught by the opened cover 1.

Figure 4:
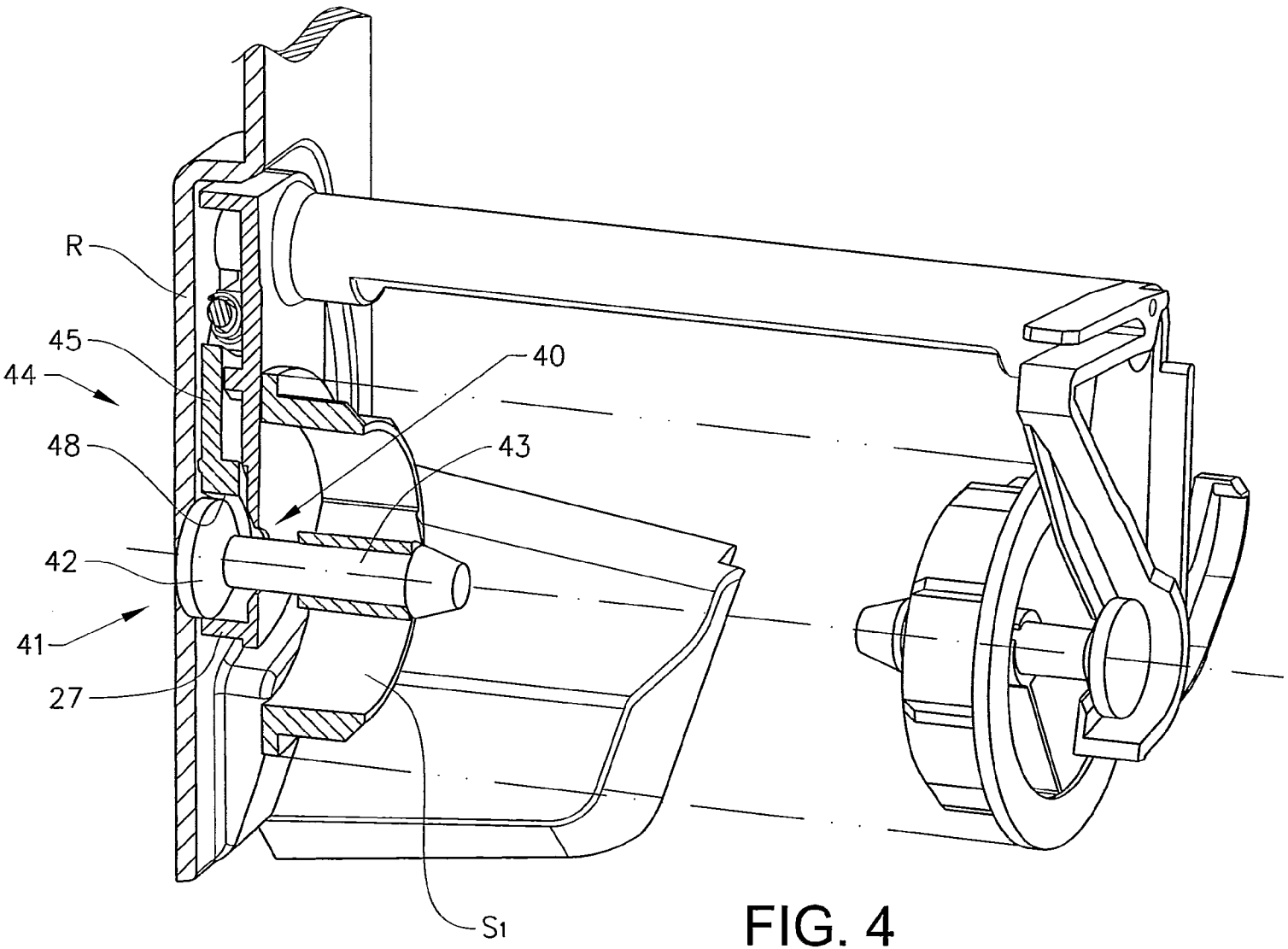
FIG. 4 shows a cross-section of a pivotable lever along the section X-X in FIG. 3.

FIG. 4 shows a cross-section of a lever along the section X-X in FIG. 3. In order to support the roll, the levers 27 and the spindle means $S_1$ are provided with cooperating interlocking surfaces. Both levers 27, 28 comprise a keyed slot having a cross-section corresponding to an axial cross-section of a spindle means. According to the example shown in FIG. 4, the retaining means comprises a keyed slot arranged to support an axially extending spindle 41 on the spindle means $S_1$. The spindle 41 is provided with an axially outer, conical section 42, having a relatively larger diameter, and an axially inner, cylindrical section 43, having a relatively smaller diameter. Although an outer conical section is preferred, other shapes such as a hemispherical or cylindrical are also possible. At least one retaining means 44 mounted on the lever 27 (see FIG. 2) may comprise a catch 45 resiliently held in contact with a circumferential surface of the cylindrical end of the substantially conical section 42 of the spindle means $S_1$. According this example, the catch 45 is arranged on the pivotable lever 27 with a pivot joint 46 having an axis parallel to the axis of the transverse bar 29. Resilient means in the form of a spring 47 holds a contact surface 48 on the catch 45 in contact with the cylindrical surface 43 of the spindle. This maintains the catch 45 in a spring loaded, active position to act as a brake to prevent free rotation of the roll during dispensing. At the same time, a roll moving into the stub roll position 25 is allowed to displace the lever 27 against the action of the spring 47. The retaining means 44 can be mounted on the levers on either or both sides of the stub roll.

According to the preferred embodiment described above, the spindle means comprises separate adapters inserted into each end of a roll. If the adapters are inserted into each end of a coreless roll, the retaining means will keep the spindle means from dropping out of the roll dispenser until the cover is opened for re-filling. Similarly, if the spindle means comprises adapters inserted into each end of a roll provided with a split core, the spindle means and both halves of the core will be retained in the dispenser. Although not primarily intended for such rolls, the dispenser may also be operated using adapters inserted into each end of a roll with a solid core. In this way it is possible to prevent the spindle means from an exhausted roll from dropping out of the dispenser until the dispenser is opened.

The invention is not limited to the above examples, but may be varied freely within the scope of the claims.

The invention claimed is:

1. A dispenser for rolls of flexible sheet material, each of said rolls having ends and spindle means inserted into each end of said rolls thereof with axially extending portions extending axially outwardly beyond the ends of said rolls, one of said rolls comprising a first roll wherein the first roll is located in a dispensing position, the dispenser comprising a stub roll position arranged to receive the first roll after the first roll has been exhausted to a predetermined extent, and retaining means being arranged on both sides of the stub roll position to support the spindle means on an outer surface of each axially extending portion of the spindle means, said spindle means being held in contact with a contact surface of said retaining means, wherein the retaining means are arranged for simultaneous release of the spindle means when the dispenser is opened.

2. The dispenser according to claim 1, wherein the retaining means are arranged to support the rotatable spindle means as long as the roll is located in the stub roll position.

3. The dispenser according to claim 1, wherein the retaining means are arranged to release the spindle means when a dispenser cover is moved from a closed to an open position.

4. The dispenser according to claim 1, wherein the spindle means comprise a pair of adapters joined along the central axis of a roll.

5. The dispenser according to claim 1, wherein the spindle means comprise separate adapters inserted into each end of a roll.

6. The dispenser according to claim 5, wherein the spindle means comprise adapters inserted into each end of a coreless roll.

7. The dispenser according to claim 5, wherein the spindle means comprise adapters inserted into each end of a roll provided with a split core.

8. The dispenser according to claim 5, wherein the spindle means comprise adapters inserted into each end of a roll provided with a solid core.

9. The dispenser according to claim 5, wherein the spindle means comprise adapters adhesively attached to each end of a coreless or solid core roll.

10. The dispenser according to claim 1, wherein a second roll is located in a reserve position above said dispensing position.

11. A dispenser for rolls of flexible sheet material, each of said rolls having ends and spindle means inserted into each end of said rolls, said spindle means extending axially outwardly beyond the ends of said rolls, one of said rolls comprising a first roll wherein the first roll is located in a dispensing position, the dispenser comprising a stub roll position arranged to receive the first roll after the first roll has been exhausted to a predetermined extent, and retaining means being arranged on both sides of the stub roll position to support the spindle means inserted into each end of a roll, wherein the retaining means are arranged for simultaneous release of the spindle means when the dispenser is opened, wherein the retaining means and the spindle means are provided with cooperating interlocking surfaces.

12. The dispenser according to claim 11, wherein the retaining means comprise a keyed slot having a cross-sectional shape corresponding at least in part to an axial cross-sectional shape of a spindle means.

13. The dispenser according to claim 12, wherein the retaining means comprises a keyed slot arranged to support a spindle means provided with an axially inner, cylindrical section and an axially outer, enlarged section.

14. A dispenser for rolls of flexible sheet material, each of said rolls having ends and spindle means inserted into each end of said rolls, said spindle means extending axially outwardly beyond the ends of said rolls, one of said rolls comprising a first roll wherein the first roll is located in a dispensing position, the dispenser comprising a stub roll position arranged to receive the first roll after the first roll has been exhausted to a predetermined extent, and retaining means being arranged on both sides of the stub roll position to support the spindle means, wherein the retaining means are arranged for simultaneous release of the spindle means when the dispenser is opened, wherein the retaining means comprise a pivotable lever on either side of the stub roll position.

15. The dispenser according to claim 14, wherein the levers are connected by a transverse bar parallel to the roll axis.

16. The dispenser according to claim 14, wherein the levers are arranged to be actuated by gravity to release the spindle mean.

* * * * *